United States Patent [19]

Lovell et al.

[11] 4,085,809

[45] Apr. 25, 1978

[54] RECONDITIONABLE DRILL BIT ASSEMBLY

[76] Inventors: Robert Lovell, 224 Burning Tree Dr., Naples, Fla. 33940; John K. Stott, 16 Glen Edyth Place, Toronto, Canada

[21] Appl. No.: 757,928

[22] Filed: Jan. 10, 1977

[51] Int. Cl.[2] ..... E21C 13/00

[52] U.S. Cl. ..... 175/410; 175/418

[58] Field of Search ..... 175/410, 412, 413, 400, 175/409, 411

[56] References Cited

U.S. PATENT DOCUMENTS

| | | | |
|---|---|---|---|
| 1,039,909 | 10/1912 | Decker | 175/413 X |
| 3,186,500 | 6/1965 | Boice | 175/374 |
| 3,536,150 | 10/1970 | Stebley | 175/410 |
| 3,771,612 | 11/1973 | Adcock | 175/374 X |
| 3,932,952 | 1/1976 | Helton et al. | 175/410 X |
| 3,997,011 | 12/1976 | Staroba | 175/410 X |

FOREIGN PATENT DOCUMENTS

| | | | |
|---|---|---|---|
| 1,331,914 | 6/1963 | France | 175/410 |
| 269,103 | 3/1969 | U.S.S.R. | 175/410 |

*Primary Examiner*—Ernest R. Purser
*Assistant Examiner*—Richard E. Favreau
*Attorney, Agent, or Firm*—McGlynn and Milton

[57] ABSTRACT

A reconditionable drill bit assembly comprising a drill bit body having a thrust face at one end and a head section separably connected to the drill bit body, the head section including a working face and an opposite rear face engaging the thrust face of the drill bit body, a plurality of bores extending through the head section and opening on the working face, the bores including a tapered seat portion adjacent the working face and a generally cylindrical section extending from the seat portion to the rear face, a tapered carbide cutting insert seated in the seat portion and a back-up pin located in the cylindrical section engaging the inner end of the cutting insert and the thrust face to hold the cutting insert in place whereby the cutting inserts are replaceable by separating the head section the drill bit body and removing the back-up pins and the cutting inserts through the cylindrical sections of the bores.

4 Claims, 2 Drawing Figures

RECONDITIONABLE DRILL BIT ASSEMBLY

FIELD OF THE INVENTION

This invention relates to a drill bit assembly for use with in-the-hole equipment.

BACKGROUND OF THE INVENTION

It has long been the practice in the hard rock mining industry to employ drill bits which are machined from bar to produce an integral drill bit body and head section. Such drill bits usually include internal fluid passageways for carrying flushing fluid to the working face of the drill bit and also flutes around the periphery of the drill bit to carry flushing fluid away from the working face to clean the hole.

In currently used drill bits of this type, the working face of the head section includes carbide cutting inserts, usually referred to as carbide buttons. The carbide buttons are press-fitted into blind bores drilled in the working face of the drill bit. The carbide buttons can be sharpened a limited number of times to maintain the drilling efficiency of the bit. However, the carbide buttons eventually wear or break to the point that further sharpening has little or no effect. When this occurs, the entire drill bit is discarded since it is impossible to replace the carbide buttons. A drill bit designed to permit replacement of the carbide buttons would eliminate the waste associated with past practice.

Drill bit assemblies have been proposed in the past in which the carbide cutting elements are replaceable. However, these designs have apparently been unacceptable in drill bits used with in-the-hole drilling equipment. One important consideration is that the carbide inserts have a relatively simple shape which corresponds generally to the shapes currently manufactured in the carbide tool industry.

BRIEF DESCRIPTION OF THE INVENTION

The instant invention provides a reconditionable drill bit assembly wherein the carbide cutting inserts can be quickly and easily replaced thereby extending the life of the drill bit. More specifically, the drill bit assembly includes a drill bit body having means at one end for attaching the assembly to a drill string and a thrust face at the opposite end. A head section is separably connected to the drill bit body. The head section includes a working face and an opposite rear face which, when the head section is connected to the drill bit body, engages the thrust face. A plurality of bores are drilled in the head section which extends through the head section and open on the working face. The bores include a tapered seat portion adjacent the working face and a generally cylindrical section extending to the rear face. The seat portion is adapted to receive a tapered, carbide cutting insert which snugly fits in the seat portion. A back-up pin is located in the cylindrical section of the bore which engages the inner end of the carbide cutting insert and extends rearwardly to the rear face of the head section so that it engages the thrust face of the drill bit body to hold the cutting insert in place.

When the carbide cutting inserts are worn to the point at which they can no longer be sharpened, the head section is separated from the drill bit body to expose the back-up pins. The back-up pins are then removed from the cylindrical sections and the cutting inserts are knocked out of their seats through the cylindrical sections. New cutting inserts are then dropped into the seat portions of the bores, the back-up pins are replaced and the head section is reunited with the drill bit body.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
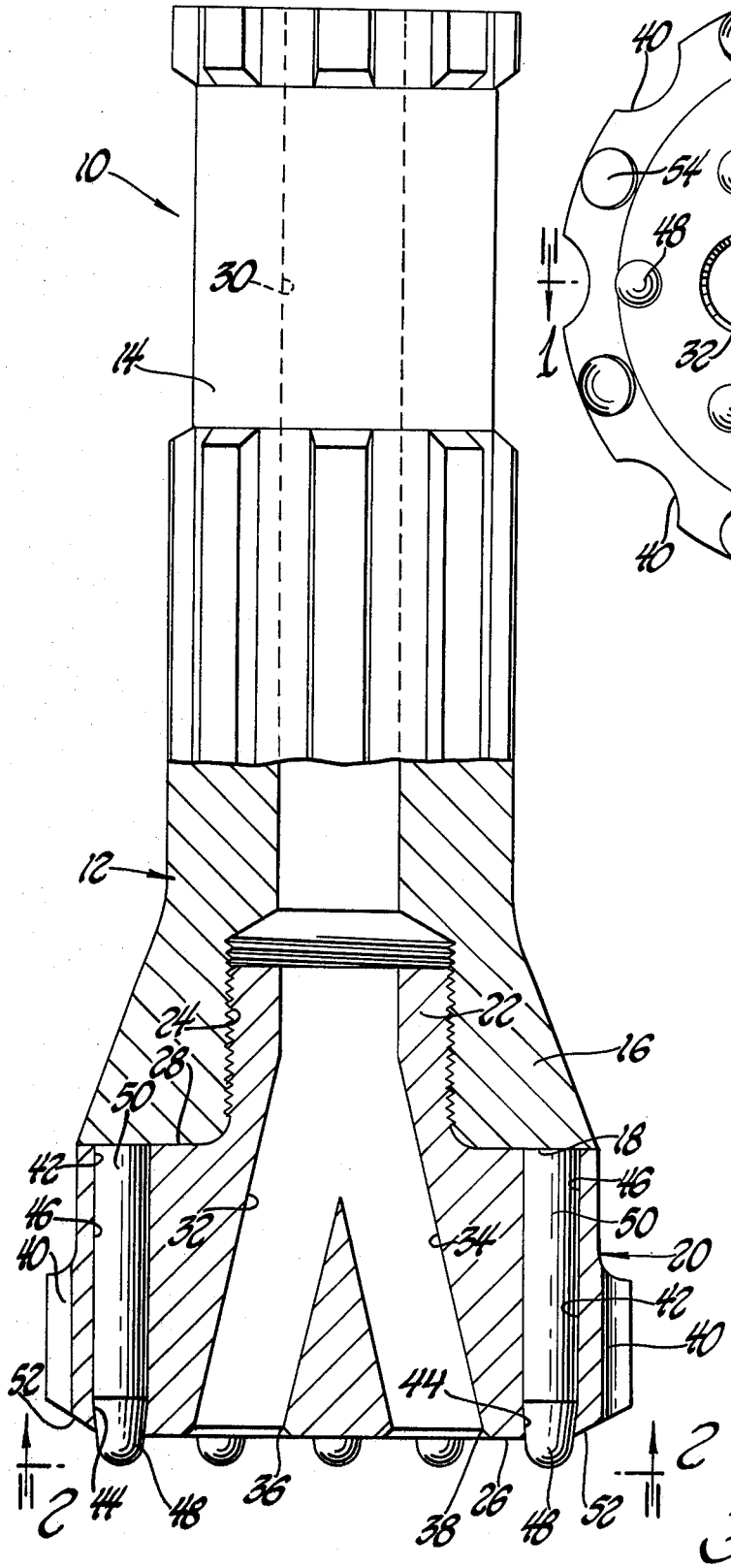
FIG. 1 is a front-sectional view, partly in cross section, of a drill bit assembly constructed in accordance with the instant invention taken generally along line 1—1 of FIG. 2.
Figure 2:
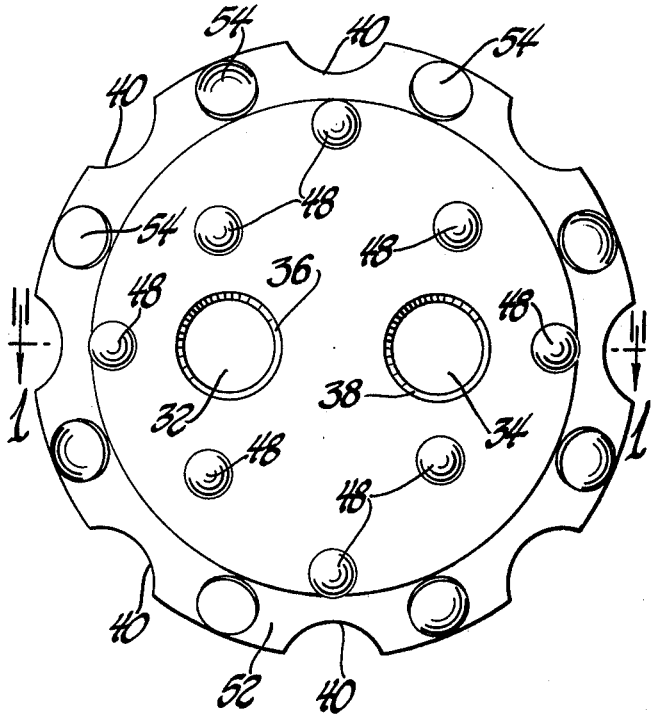
FIG. 2 is a view of the drill bit assembly taken generally along line 2—2 of FIG. 1.

Referring more particularly to the drawings, a drill bit assembly constructed in accordance with the instant invention is generally shown at 10.

The drill bit assembly 10 includes a drill bit body, generally indicated at 12, which includes a shank portion 14 of standard design. That is, the shank portion 14 includes means for attaching the drill bit assembly 10 to a drill string. Below the shank portion 14 of the drill bit body is an enlarged portion 16 which terminates in a thrust face 18.

A head section generally indicated at 20 is separably connected to the enlarged section 16 of the drill bit body 12. For this purpose, the head section 20 is provided with a centrally located integral shaft 22 having external threads. A threaded bore 24 is machined in the drill bit body 12 to receive the threaded shaft 22 of the head section 20. The direction of the threads is selected so that the direction of rotation of the drill bit assembly 10 will not tend to unscrew the head section 20 from the drill bit body 12 during operation.

The head section 20 includes a working face 26 which is exposed to the bottom of the hole being drilled. The head section also includes an opposite rear face 28 which fits against the thrust face 18 of the drill bit body 12.

As is common, the drill bit includes internal fluid passageways for delivering flushing fluid to the working face 26 of the drill bit. More specifically, the drill bit body 12 includes a passageway 30 which extends along the central axis of the drill bit body 12. The passageway 30 extends into the threaded shaft 22 of the head section 20 and then is divided into two diverging branches 32 and 34 which terminate in outlets 36 and 38 respectively. Flushing fluid, usually water, is forced down the fluid passageways 30, 32 and 34 into the drill hole to clean the hole. The head section 20 also includes a plurality of external flutes 40 which define fluid passageways for conducting, or carrying, flushing fluid and remnants away from the working face 26 of the drill bit assembly 10.

The head section 20 includes a plurality of bores 42 extending therethrough and opening on the working face 26. Each of the bores include a tapered seat portion 44 adjacent the working face having walls which converge in the direction of the working face 26. The bores also include a generally cylindrical section 46 extending from the tapered seat portions 44 to the rear face 28 of the head section 20.

The seat portions 44 are dimensioned to receive similarly tapered, carbide cutting inserts 48. As shown in FIG. 1 the carbide inserts 48 have tapered sides and a rounded end. The inserts are dimensioned so that, when properly positioned in the seat portions 44, the rounded ends extend out of the working face 26 of the head section 20.

The cutting inserts 48 need not be press-fitted into the head section 20, but only snugly fit into the seat portions 44. The cutting inserts 48 are held in place by hardened steel back-up pins 50 which fit into the cylindrical portions 46 of the bores 42. The back-up pins 50 extend to the rear face 28 of the head section 20 so that their ends are flush with the rear face 28. Consequently, when the head section 20 is turned into place, the back-up pins 50 engage the thrust face 18 of the drill bit body 12. The cooperation between the back-up pins 50 and the thrust face 18 wedge the cutting inserts 48 in place.

When it becomes desirable to replace the cutting inserts, the head section 20 is separated from the drill bit body 12. The back-up pins 50 are then removed and the worn carbide inserts 48 are knocked rearwardly through the cylindrical sections 46 of the bores 42. New carbide inserts are dropped into the seat portions 44, the back-up pins 50 are replaced and the head section 20 is screwed onto the end of the drill bit body 12. In this manner, the drill bit assembly 10 can be quickly and easily reconditioned.

The head section 20 also includes a chamfered surface 52 around the periphery of the working face 26. In many drill bit assemblies, the surface 52 is provided with carbide cutting inserts 54. Back-up pins may be provided for these inserts 54 in generally the same manner as described above. Alternatively, since these inserts do not wear as quickly as the inserts on the working face 26, they may be press-fitted into blind bores. When these carbide inserts 54 wear to the point that they can no longer be sharpened, only the head section 20 need be replaced. This is in contrast to previous practice in which the entire drill bit body has been discarded.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A reconditionable drill bit assembly comprising: a drill bit body including means at one end for attaching the assembly to a drill string and a thrust face at the opposite end and a head section separably connected to said drill bit body; said head section including a working face and an opposite rear face engaging said thrust face and a plurality of bores extending through said head section and opening on said working face, said bores including a tapered seat portion adjacent said working face and a generally cylindrical section extending from said seat portion to said rear face, a tapered carbide cutting insert seated in said seat portion and a back-up pin located in said cylindrical section engaging the inner end of said cutting insert and said thrust face to hold said cutting insert in place whereby said cutting inserts are replaceable by separating said head section from said drill bit body and removing said back-up pins and said cutting inserts through said cylindrical sections of said bores.

2. An assembly as set forth in claim 1 including a centrally located, integral threaded shaft extending from one of said drill bit body and said head section and a threaded bore in the other of said members for separably connecting said drill bit body to said head section.

3. An assembly as set forth in claim 2 including internal fluid passageways extending through said drill bit body and said head section for delivering flushing fluid to said working face.

4. An assembly as set forth in claim 3 including a plurality of external flutes for defining fluid passageways for carrying flushing fluid away from said working face.

* * * * *